US009045257B2

(12) United States Patent
Nolet et al.

(10) Patent No.: US 9,045,257 B2
(45) Date of Patent: Jun. 2, 2015

(54) GRAB BAR AND A CONTAINER PROVIDED THEREWITH

(71) Applicant: IPL INC., St-Damien (CA)

(72) Inventors: Roch Nolet, St-Joseph (CA); Luc Petitpas, L'Ancienne-Lorette (CA); Francis Côté, St-Nicolas (CA); Yvan Marcoux, St-Joseph-De Beauce (CA)

(73) Assignee: IPL INC., St-Damien (CA)

( * ) Notice: Subject to any disclaimer, the term of this patent is extended or adjusted under 35 U.S.C. 154(b) by 0 days.

(21) Appl. No.: 14/463,779

(22) Filed: Aug. 20, 2014

(65) Prior Publication Data

US 2015/0053706 A1 Feb. 26, 2015

Related U.S. Application Data

(60) Provisional application No. 61/867,676, filed on Aug. 20, 2013.

(51) Int. Cl.
*B65D 25/28* (2006.01)
*B25G 1/10* (2006.01)

(52) U.S. Cl.
CPC ..... *B65D 25/2867* (2013.01); *B25G 1/10* (2013.01)

(58) Field of Classification Search
CPC ..... B65D 25/2867; B65D 25/2817; B65D 25/2805; B65D 25/2802; B65D 25/2808; B65D 25/28; B65F 1/1452; B65F 1/14
USPC ..... 220/759, 752, 908, 770; 16/425, 422, 16/110.1, 430; D34/27, 5, 1
See application file for complete search history.

(56) References Cited

U.S. PATENT DOCUMENTS

D291,739 S 9/1987 Orlowski
D313,491 S 1/1991 Edelhoff et al.

(Continued)

FOREIGN PATENT DOCUMENTS

CA 2624658 A1 9/2009
CA 2624663 A1 9/2009
CA 2636306 A1 9/2009

OTHER PUBLICATIONS

Cascade Waste and Recycling Carts; http://www.cascadecartsolutions.com/products/waste-recycling-carts/icon-series; Dec. 14, 2012

(Continued)

*Primary Examiner* — Robert J Hicks
(74) *Attorney, Agent, or Firm* — Goudreau Gage Dubuc; Gwendoline Bruneau

(57) ABSTRACT

A grab bar comprising a body with open opposite ends and diametrically opposed apertures close to the open ends; and a cap supporting a central leg supporting flexible side legs, each side leg comprising a protrusion at a free extremity thereof and being adapted to flex inwards toward the central leg as the central leg is inserted within the body from the open end thereof until the protrusions engage a respective the apertures in the body and emerge out of the outer surface of the body, and the cap is generally flush with an edge of the open end of the body; and the side legs being adapted to flex inwards toward the central leg as the protrusions are pushed toward the central leg thereby disengaging the protrusions from the apertures in the body and allowing the cap to be pulled out from the open end of the body.

4 Claims, 15 Drawing Sheets

(56) References Cited

U.S. PATENT DOCUMENTS

| | | | | |
|---|---|---|---|---|
| 5,251,780 | A * | 10/1993 | Lee | 220/630 |
| D355,741 | S | 2/1995 | Craft et al. | |
| D365,428 | S | 12/1995 | Prout et al. | |
| D398,120 | S | 9/1998 | Rehrig et al. | |
| D410,125 | S | 5/1999 | Rehrig et al. | |
| D429,398 | S | 8/2000 | Wysocki | |
| D445,228 | S | 7/2001 | Apps et al. | |
| D470,989 | S | 2/2003 | Tuduri | |
| D474,319 | S | 5/2003 | Tuduri | |
| D477,899 | S | 7/2003 | Tuduri | |
| D478,197 | S | 8/2003 | Raghunathan | |
| D491,328 | S | 6/2004 | Aiken et al. | |
| 7,070,064 | B1 | 7/2006 | Henry et al. | |
| 7,121,564 | B2 | 10/2006 | Hassell | |
| D532,173 | S | 11/2006 | Aiken et al. | |
| D535,448 | S | 1/2007 | Kilduff et al. | |
| 7,172,088 | B2 | 2/2007 | McDade et al. | |
| D564,722 | S | 3/2008 | Hogarth et al. | |
| D577,170 | S | 9/2008 | Meers | |
| D624,723 | S | 9/2010 | Raghunathan et al. | |
| D634,912 | S | 3/2011 | Pouliot et al. | |
| D641,121 | S | 7/2011 | Rampton et al. | |
| D643,174 | S | 8/2011 | Raghunathan et al. | |
| D646,037 | S | 9/2011 | Arthurson | |
| 8,141,455 | B2 * | 3/2012 | Ogburn | 74/551.8 |
| D657,106 | S | 4/2012 | Talbot Pouliot et al. | |
| D659,338 | S | 5/2012 | Gardner | |
| 8,424,714 | B2 | 4/2013 | Kruse et al. | |
| 8,430,267 | B2 | 4/2013 | Kilduff et al. | |
| 2003/0155366 | A1 | 8/2003 | Raghunathan | |
| 2003/0213808 | A1 | 11/2003 | Berger | |
| 2004/0074913 | A1 | 4/2004 | McDade et al. | |
| 2009/0223965 | A1 | 9/2009 | Raghunathan et al. | |
| 2010/0230427 | A1 * | 9/2010 | Parker et al. | 220/756 |
| 2011/0049151 | A1 | 3/2011 | Raghunathan et al. | |
| 2011/0049152 | A1 | 3/2011 | Raghunathan et al. | |
| 2013/0048654 | A1 | 2/2013 | Kilduff et al. | |
| 2013/0067868 | A1 * | 3/2013 | Daudelin | 53/473 |

OTHER PUBLICATIONS

Otto Roll-out carts; http://ottoenvironmentalsystems.thomasnet-navigator.com/category/residential-refuse-and-recycling-carts; Dec. 14, 2012.

Rehrig Roll-Out Carts; http://www.rehrigpacific.com/products-and-services/waste-recycling-and-public-works/roll-out-carts-and-re-cycle-bins/roll-out-carts; Dec. 14, 2012.

Schaefer 2 wheel containers; http://www.ssi-schaefer.us/waste-management/waste-management-products/2-wheel-containers.html; Dec. 14, 2012.

Sulo; Two-wheeled roll-out cart; http://www.sulo.com.au/products/two-wheeled-2-wheelie-bin-mgb/; Dec. 14, 2012.

Toter Curbside Collection Carts, roll-out carts; http://www.toter.com/products/product-detail.cfm?product_id=F5949571-A635-17A8-0DBCEC04461A60F9; Dec. 14, 2012.

* cited by examiner

GRAB BAR AND A CONTAINER PROVIDED THEREWITH

CROSS REFERENCE TO RELATED APPLICATIONS

This application claims benefit of U.S. provisional application Ser. No. 61/867,676, filed on Aug. 20, 2013. All documents above are incorporated herein in their entirety by reference.

FIELD OF THE INVENTION

The present invention relates to a grab bar. More specifically, the present invention is concerned with a grab bar and a container provided therewith.

SUMMARY OF THE INVENTION

More specifically, in accordance with the present invention, there is provided a grab bar comprising a body with open opposite ends and diametrically opposed apertures close to the open ends; and an end cap comprising a cap supporting a central leg extending from an inner surface of the cap, the central leg supporting a first side leg and a second side leg at an extremity of the central leg opposite the cap, the side legs being flexible about the extremity of the central leg, each side leg comprising a protrusion at a free extremity thereof opposite the extremity of the central leg, wherein the side legs are adapted to flex inwards toward the central leg as the central leg is inserted within the body from the open end thereof until the protrusion of each side leg engages a respective one of the diametrically opposed apertures in the body and emerges out of the outer surface of the body, and the cap is generally flush with an edge of the open end of the body; and the side legs are adapted to flex inwards toward the central leg as the protrusion of each side leg are pushed toward the central leg thereby disengaging the protrusion from the diametrically opposed apertures in the body and allowing the cap to be pulled out from the open end of the body.

There is further provided a container comprising a base and side walls extending from the base and defining a cavity, one of the side walls supporting two facing walls, extending from the side wall and each provided with an opening, and a grab bar of a length larger than a distance between the two facing walls and spaced outwardly from the container relative to an exterior surface of the side wall; wherein the grab bar, comprises a body with open opposite ends and diametrically opposed apertures close to the open ends; and a cap supporting a central leg extending from an inner surface of the cap, the central leg supporting a first side leg and a second side leg at an extremity of the central leg opposite the cap, the side legs being flexible about the extremity of the central leg, each side leg comprising a protrusion at a free extremity thereof opposite the extremity of the central leg; wherein the side legs are adapted to flex inwards toward the central leg so as to enter the body until the protrusion of each side leg engages a respective one of the diametrically opposed apertures in the body and emerges out of the surface of the body, and the cap is generally flush with an edge of the open end of the body; the side legs are adapted to flex inwards toward the central leg as the protrusions are pushed inward inside the body thereby disengaging from the diametrically opposed apertures in the body and the cap is pulled out from the open end of the body; wherein the grab bar is adapted to be positioned between the two facing walls, a first end of the body with the cap thereon being inserted within the opening of a first one of the two facing walls by a first side of the first wall, the first side of the first wall facing the second wall, the protrusions being pushed back within the body by contact with an edge of the first opening, and reemerging from the inside of the body on a second opposite side of the first wall; and a second end of the body with the cap thereon being inserted within the opening of a second one of the two facing walls by a first side of the second wall, the first side of the second wall facing the first side of the first wall, the protrusions being pushed back within the body by contact with an edge of the second opening, and reemerging from the inside of the body on a second opposite side of the second wall; and wherein the grab bar is adapted to be removed from between the two facing walls by squeezing the protrusions inwards, thus disengaging the protrusions from the apertures of the body.

There is further provided a container comprising a bin comprising a base and side walls extending from the base, the bin defining a cavity; a pair of opposite walls extending outwardly from an external surface of one of the side walls of the bin and each provided with an opening at a distance from the bin relative to the external surface of the side wall; and a grab bar of a length larger than a distance between the opposite walls; the grab bar comprising a body with open opposite ends each comprising diametrically opposed apertures and a cap generally flush with an edge of the open end of the body and supporting a central leg extending from an inner surface of the cap within the body, the central leg supporting a first side leg and a second side leg at an extremity of the central leg opposite the cap, the side legs being flexible about the extremity of the central leg, each side leg comprising a protrusion at a free extremity thereof opposite the extremity of the central leg emerging out of the surface of the body through the aperture in the body; wherein the side legs are adapted to flex inwards toward the central leg as the protrusions are pushed inward inside the body, a first end of the body of the grab bar cap is inserted within the opening in a first one of the pair of opposite walls, by a first side of the first wall, the protrusions being pushed back within the body, and reemerging from the inside of the body on a second side of the first wall; and a second end of the body of the grab bar cap is inserted within the opening in a second one of the pair of opposite walls, by a first side of the second wall, the protrusions being pushed back within the body, and reemerging from the inside of the body on a second side of the second wall, thereby coupling the grab bar to the container in complete fluid isolation from the cavity.

There is further provided a method for providing a container with a grab bar in complete fluid isolation from the inside of the container, comprising providing two facing walls extending outwardly from an external surface of a side wall of the container; providing each one of the two facing walls with an opening at a distance from the external surface of the side wall; providing a grab bar of a length larger than a distance between the two facing walls; the grab bar comprising a body with open opposite ends each comprising diametrically opposed apertures and a cap supporting a first side leg and a second side leg extending within the body, each side leg comprising a protrusion at a free extremity thereof, the protrusion emerging out of the surface of the body through the aperture in the body, the side legs being adapted to flex inwards within the body so as to disengage the protrusion from the apertures in the body; and inserting a first end of the body of the grab bar cap within the opening in a first one of the two facing walls, by a first side of the first wall facing the second wall, the protrusions being pushed back within the body, and reemerging from the inside of the body on a second side of the first wall; and inserting a second end of the body of the grab bar cap within the opening in the second one of the two facing walls, by a first side of the second wall facing the first wall, the protrusions being pushed back within the body, and reemerging from the inside of the body on a second side of the second wall.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

Figure 1:
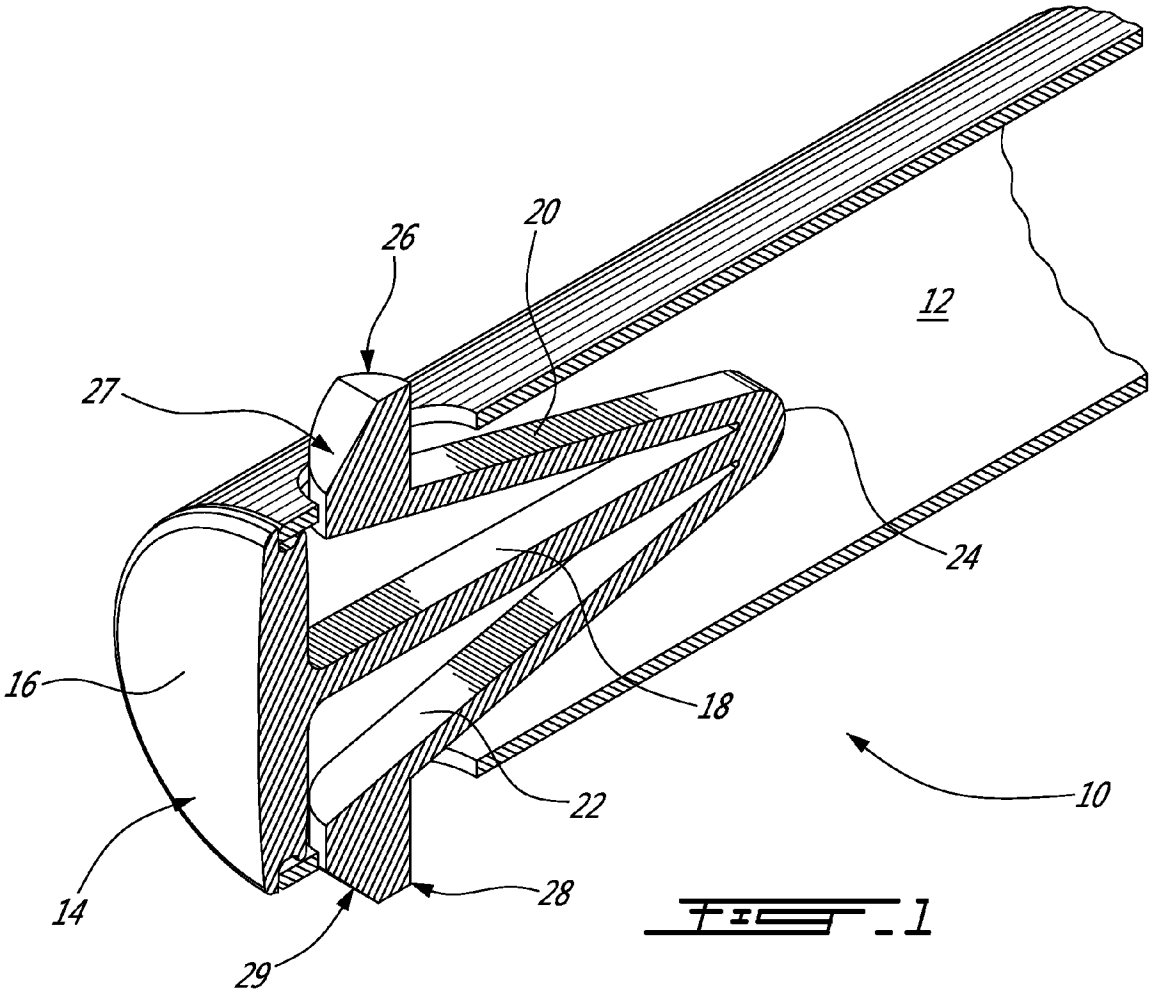
FIG. 1 is a sectional partial perspective view of a grab bar according to an embodiment of an aspect of the present invention.
Figure 2:
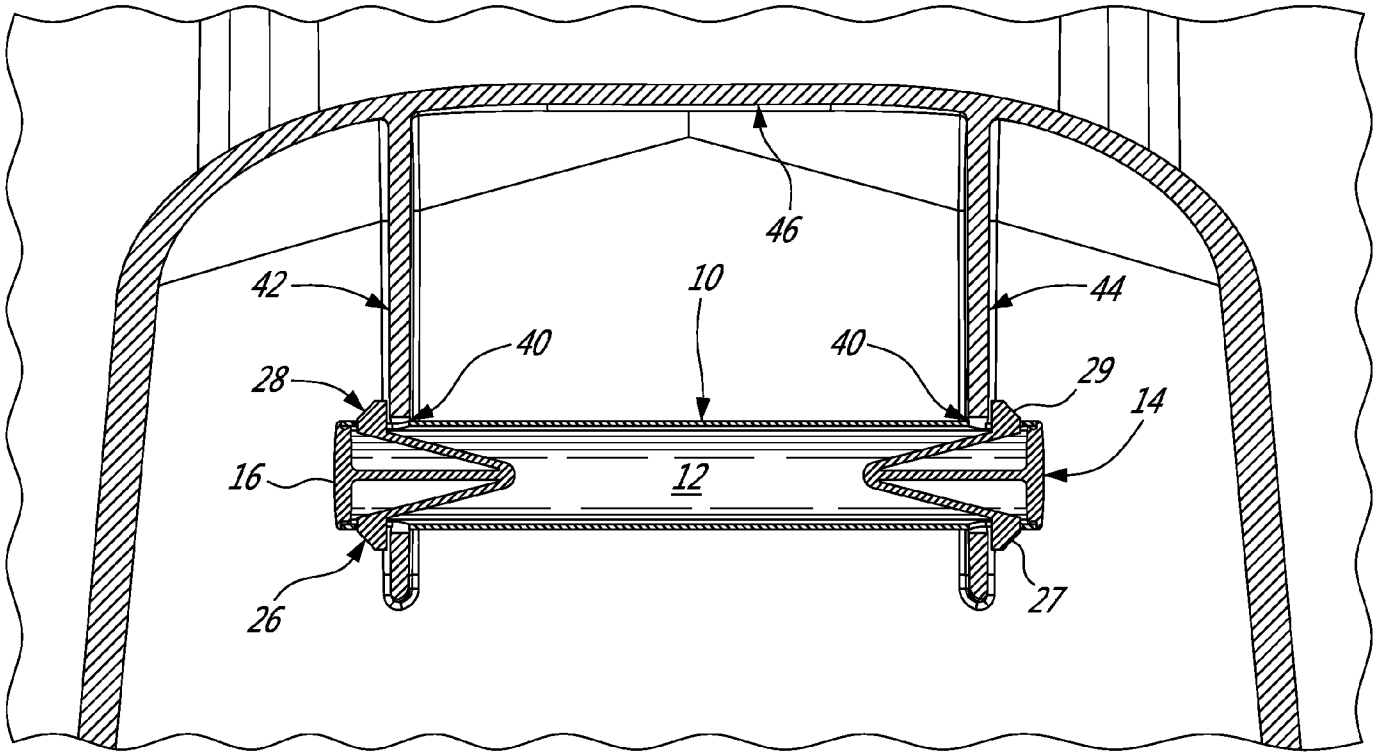
FIG. 2 is a sectional view a grab bar supported between two facing walls according to an embodiment of an aspect of the present invention.
Figure 3:
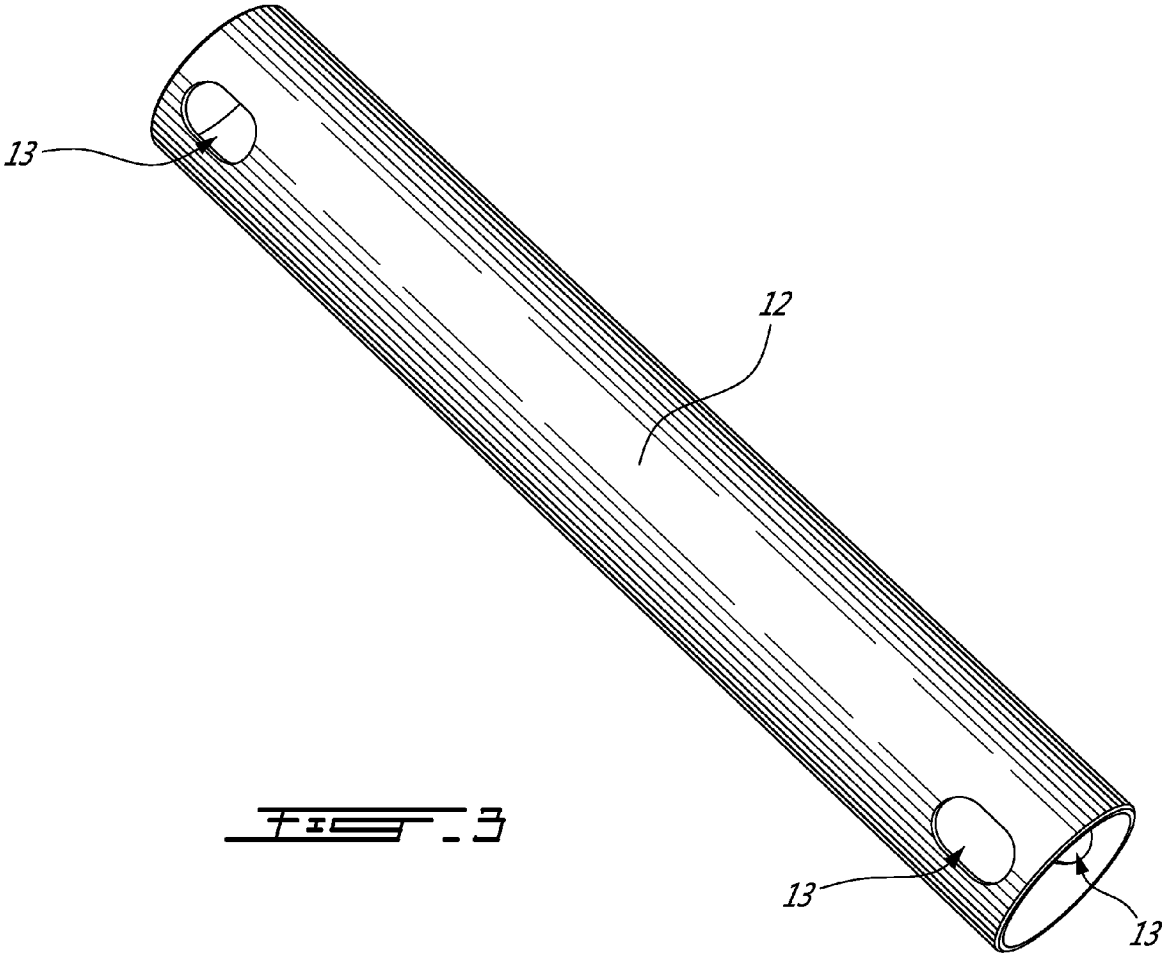
FIG. 3 is a perspective view of a body of a grab bar according to an embodiment of an aspect of the present invention.
Figure 4B:
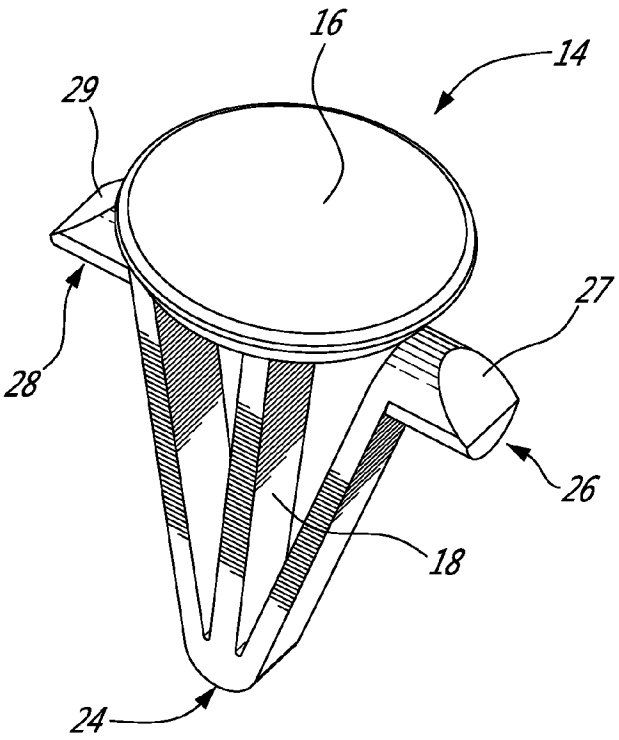
FIG. 4 show a) a first view and b) a second view of an end cap of a grab bar according to an embodiment of an aspect of the present invention.
Figure 4A:
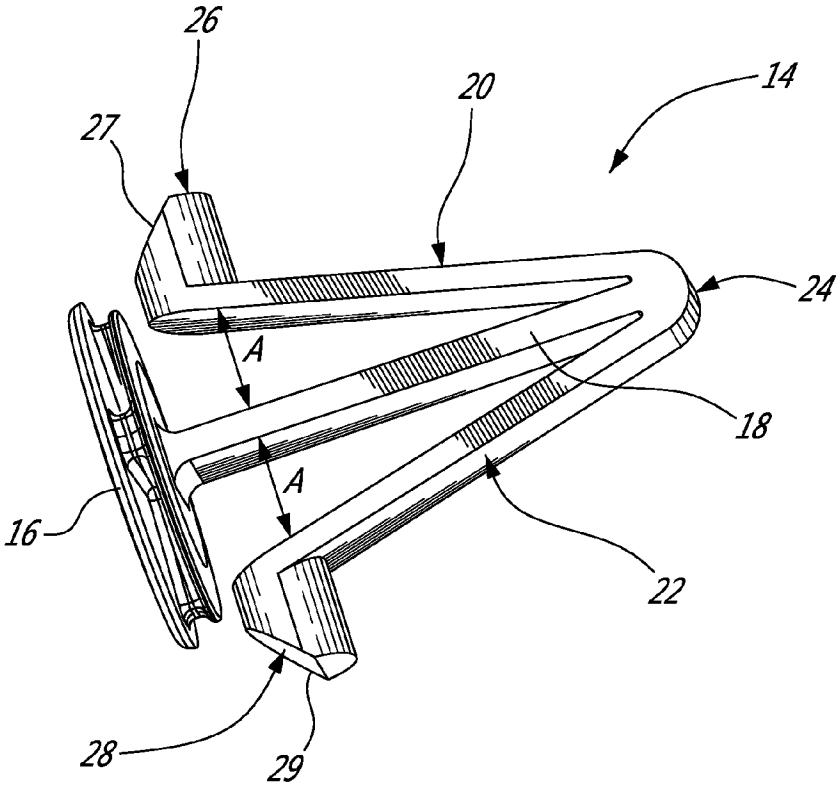

As illustrated in FIGS. 1 to 3 for example, a grab bar 10 comprises an elongated hollow body 12, which may be a generally tubular body as illustrated, or a body with a U-shaped section or a L-shaped section for example, with open ends and an end cap 14 at each open end thereof. The body 12, as best seen in FIG. 3, comprises diametrically opposed apertures 13 close to the open ends thereof. The end cap 14, illustrated in FIG. 4 for example, comprises a cap 16, adapted to sit on the edge of the open end of the body 12 and supporting a central leg 18 extending from an inner surface of the cap 16 within the body 12 as best seen in FIGS. 1 and 2 for example. The central leg 18 in turn, at an extremity 24 thereof opposite the cap 16, supports a side leg 20 and a side leg 22, the side legs 20, 22 extending from the end of the central leg 18 opposite the inner surface of the cap 16 back towards the inner surface of the cap 16. The side legs 20, 22 are flexible about the extremity 24 (see arrows A in FIG. 4*a*), so that their free extremity may releasingly flex towards the central leg 18. Each side leg 20, 22 is provided with a protrusion 26, 28 respectively at the free extremity thereof.

Figure 5:
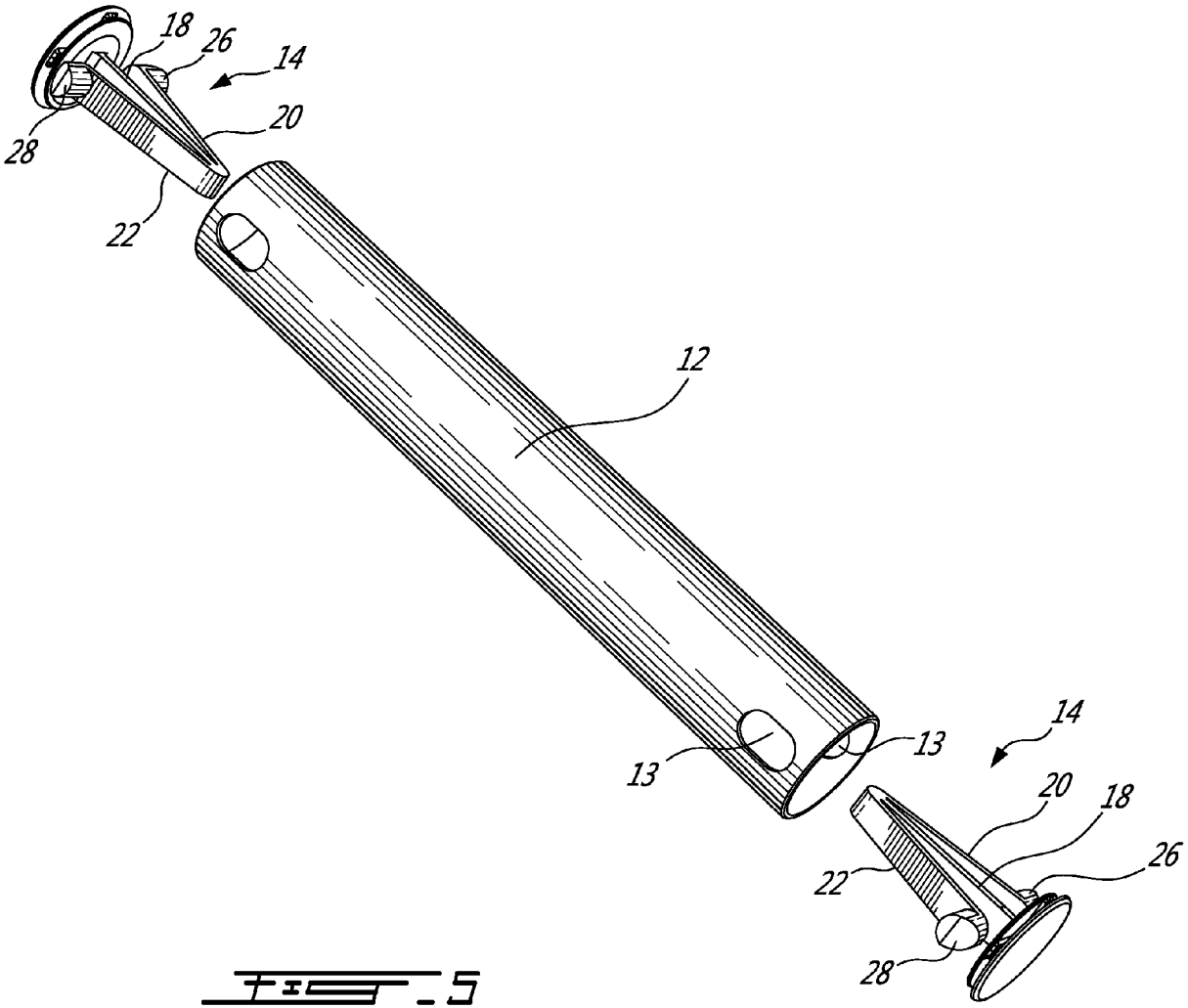
FIG. 5 shows insertion of an end cap of FIG. 4 on each extremity of the body of FIG. 3.
Figure 6:
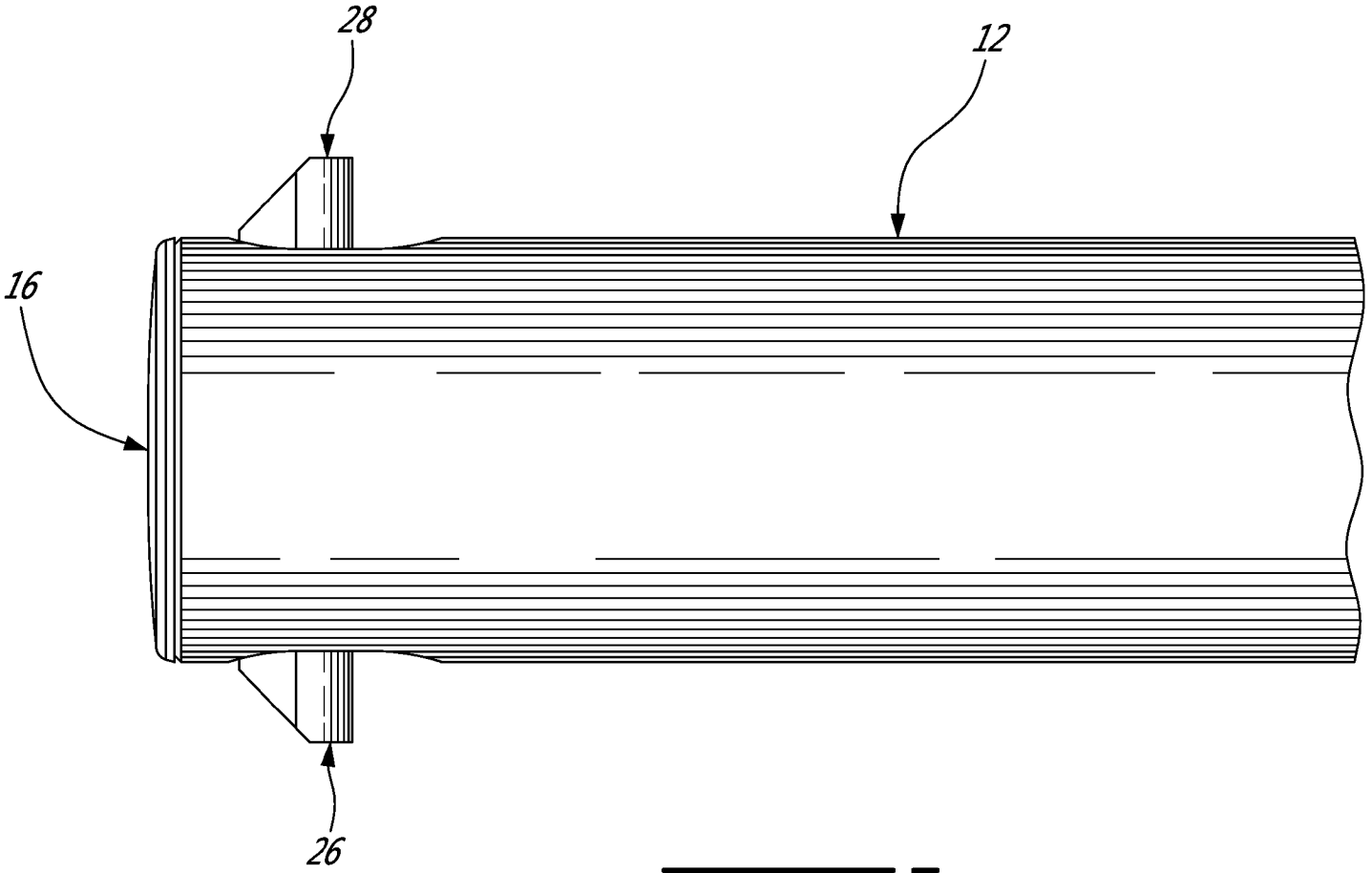
FIG. 6 shows a detail of a grab bar according to an embodiment of an aspect of the present invention.

An end cap 14 may be inserted in each open end of the body 12 as shown in FIG. 5, by inserting the legs 18, 20, 22, the side legs 20 and 22 flexing inwards toward the central leg 18 as they enter the body 12, until the protrusion 26, 28 of each side leg 20, 22 engages a respective one of the apertures 13 in the body 12 and emerges out from the outer surface of the body 12 from the inside of the body 12, and the cap 16 is generally flush with the extremity of the body 12 as shown in FIGS. 1, 2 and 6 for example. On each extremity of the body 12, an end cap 14 is thus being retained within the body by press fit (see FIG. 2 for example).

As shown in FIG. 7, the body 12 with the end caps 14 retained thereto as described hereinabove can then be positioned between two facing walls 42, 44, by inserting a first end of the body 12 within an opening 40 in a first wall 42, by a first side of the wall 42 (left hand side of wall 42 in FIG. 7*a*), the protrusions 26 and 28 being pushed back within the body 12 by contact between their sloped surface 27, 29 with the edge of the opening 40, and reemerging from the inside of the body 12 on the other side of the wall 42 (right handside of wall 42 in FIG. 7*b*).

Figure 7B:
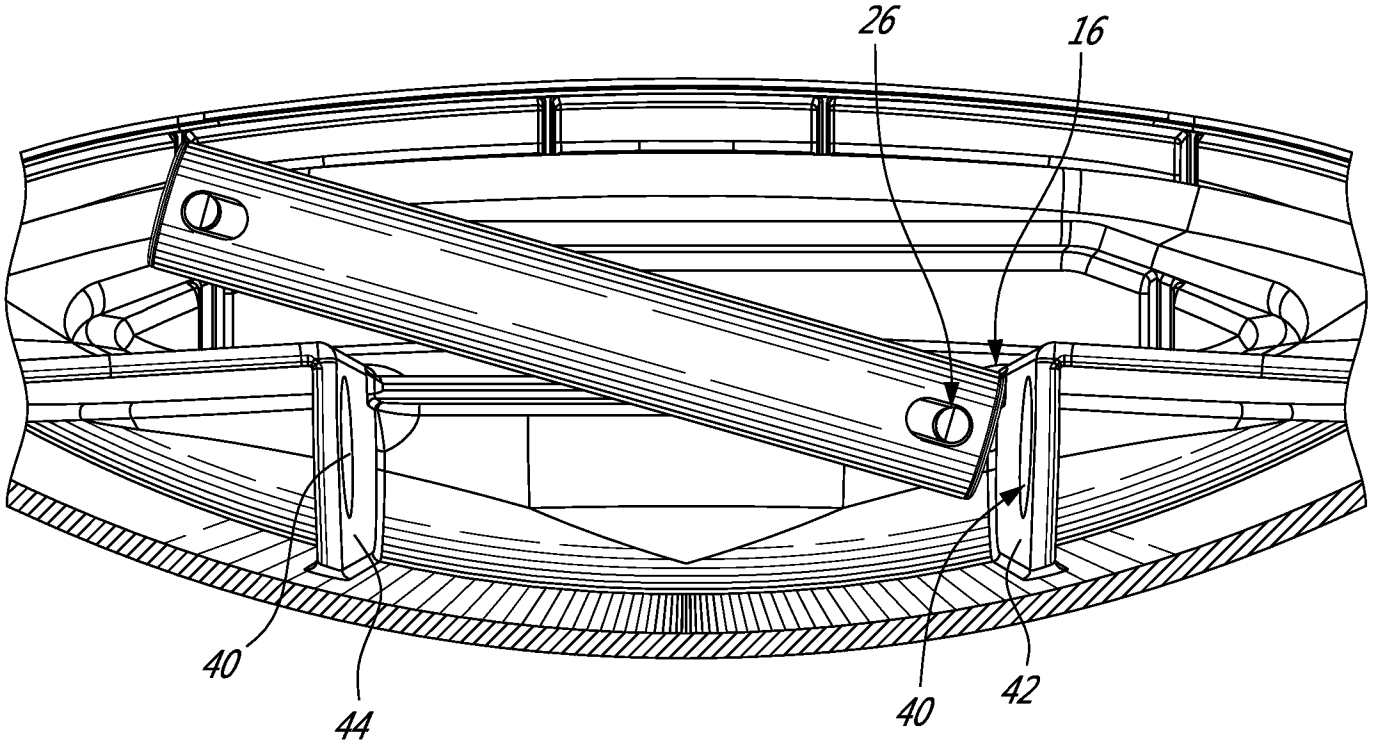
FIGS. 7*a*)-7*h*) show positioning of a grab bar between two facing walls according to an embodiment of an aspect of the present invention.
Figure 7B:
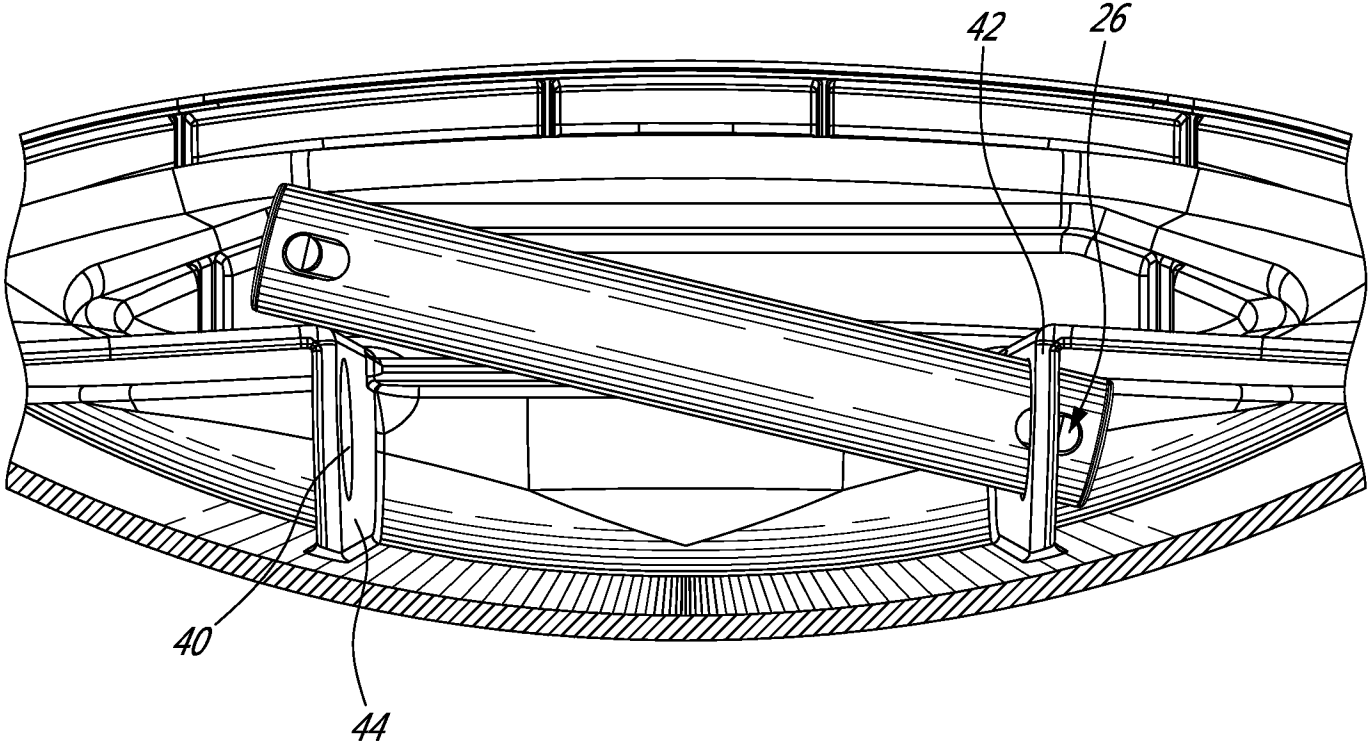
Figure 7C:
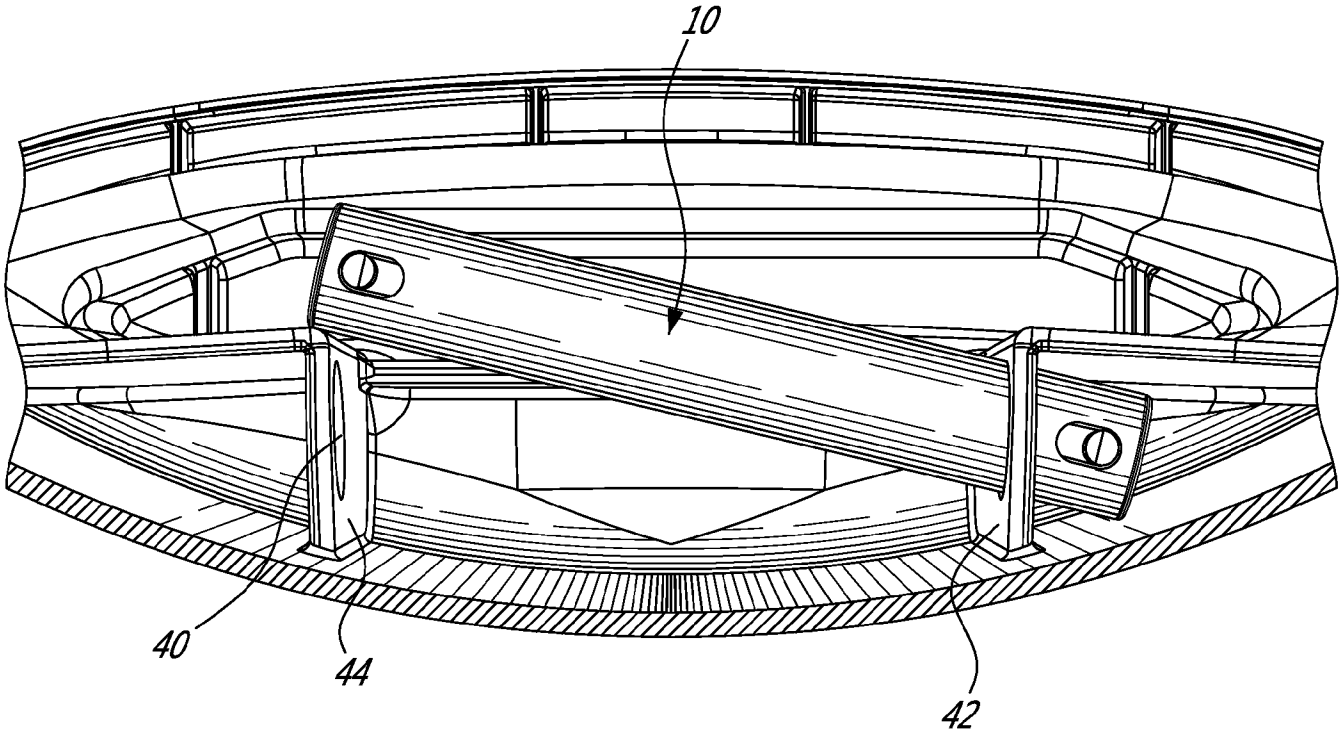
Figure 7D:
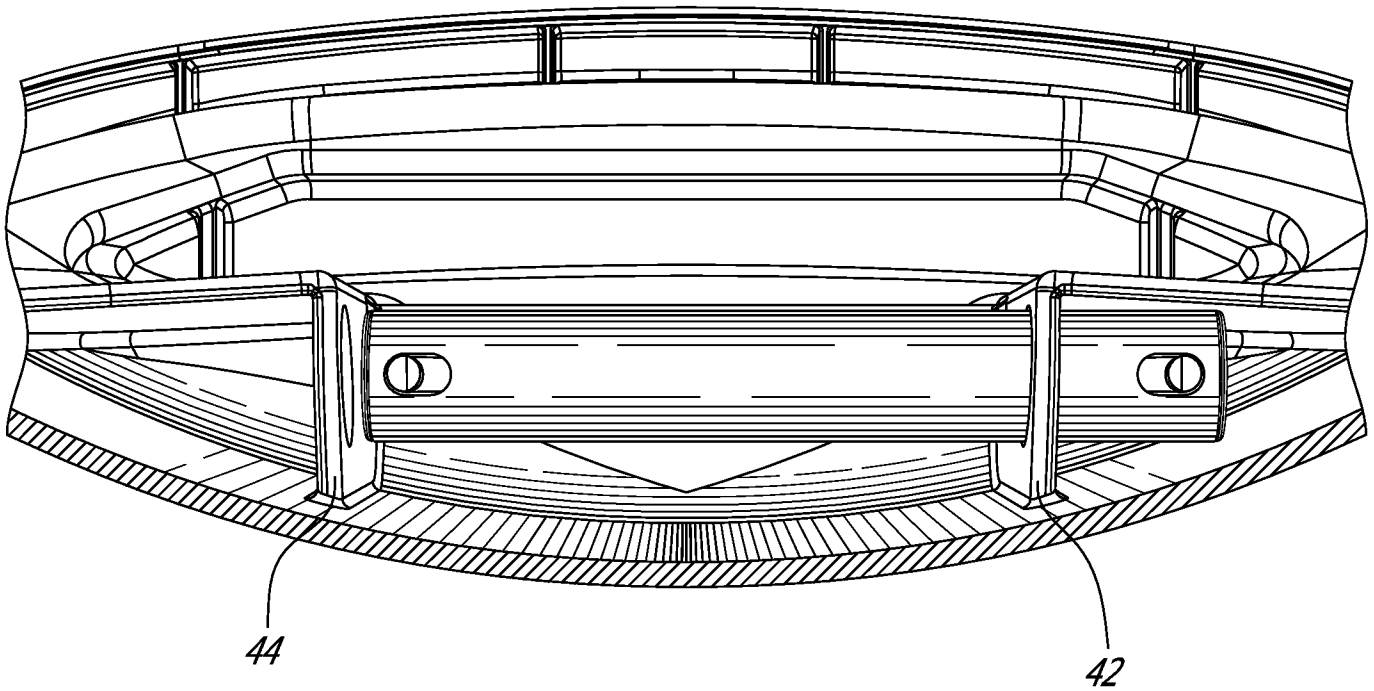
Figure 7E:
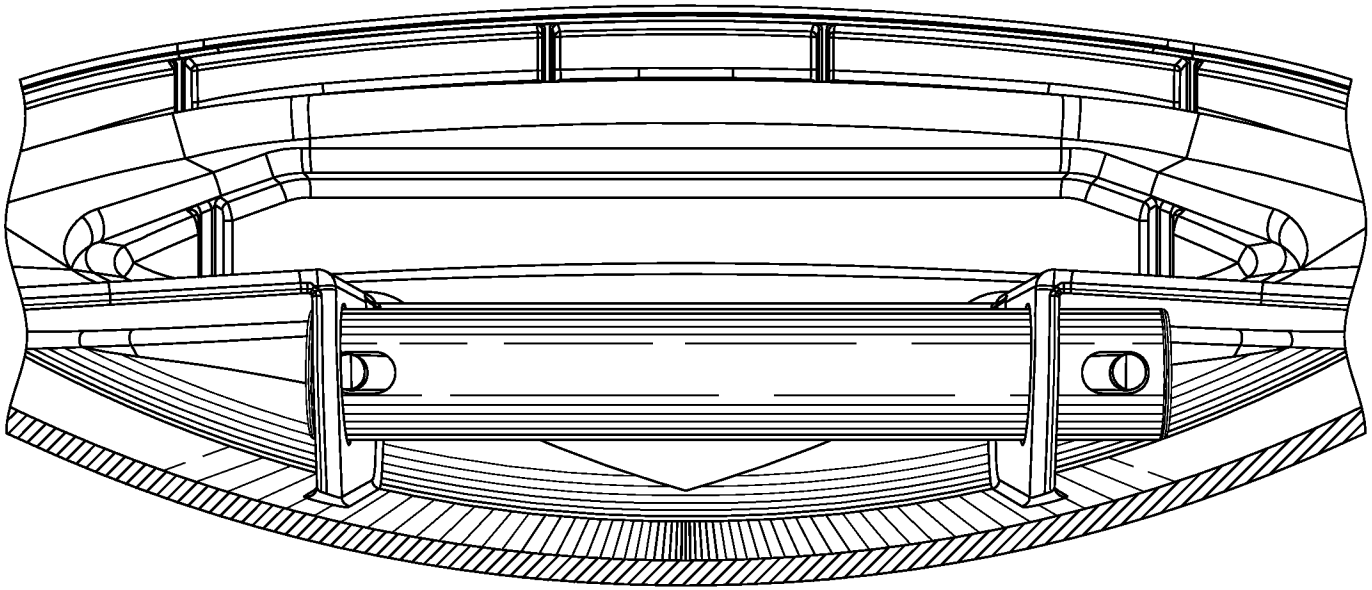
Figure 7G:
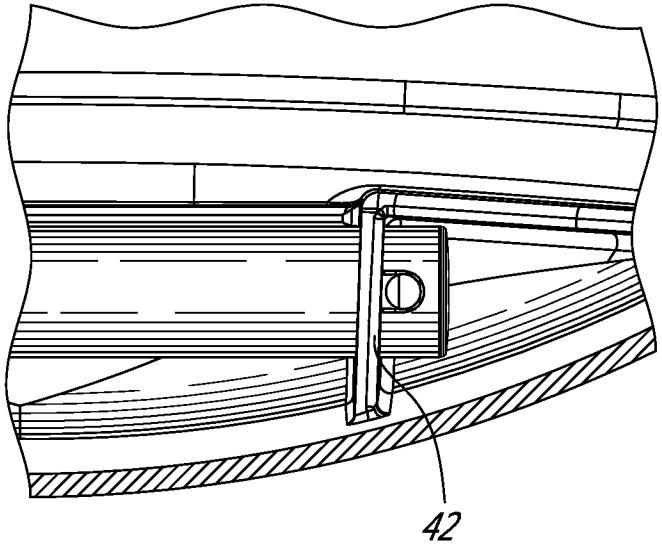
Figure 7F:
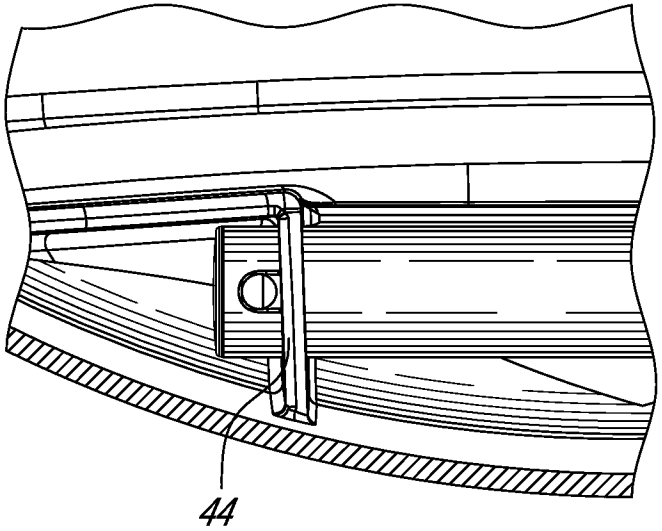

The opposite extremity of the tubular body 12 may similarly be inserted within an aperture 40 in a second wall 44 facing the first wall 42 and distant from the first wall 42 by a distance less than the length of the bar 12 (see FIGS. 7*c*-7*e*).

Figure 7H:
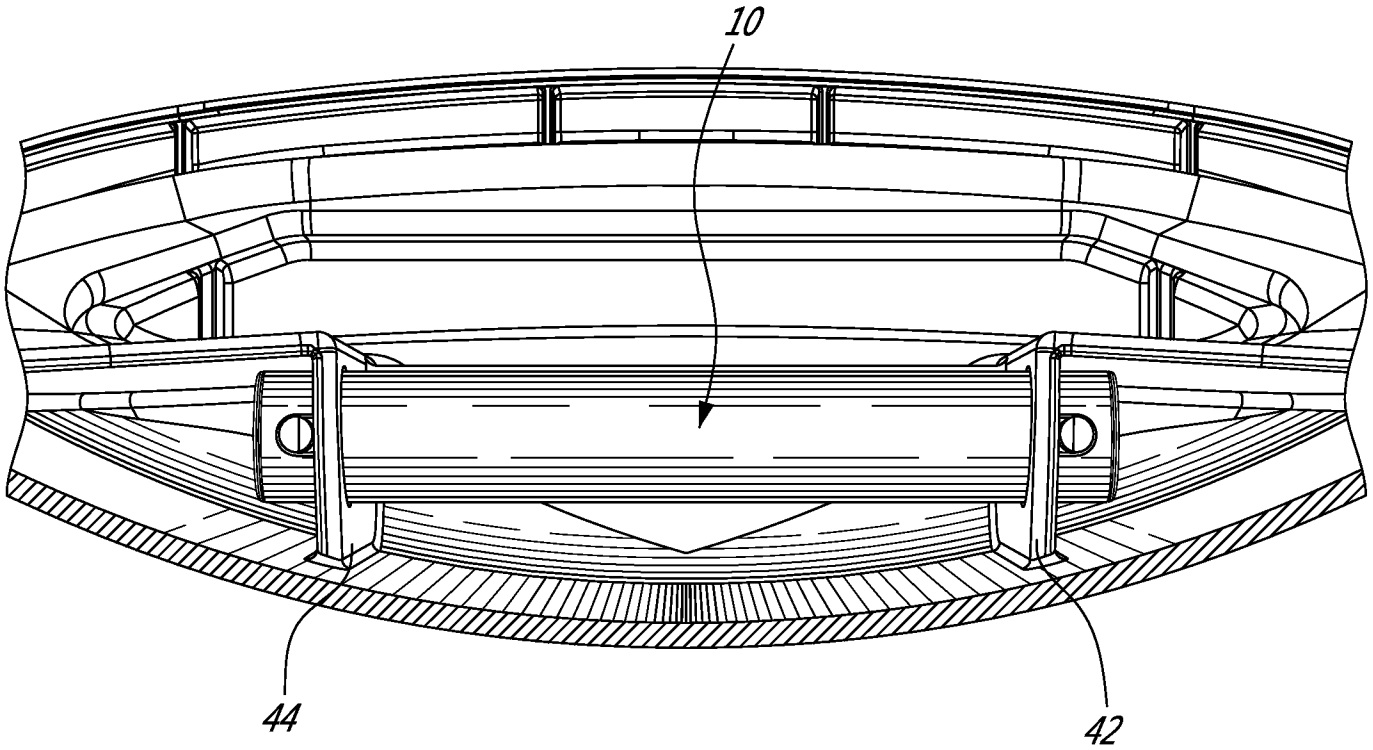

Once thus positioned with the protrusions 26, 28 emerging from the apertures 13 of the body 12 on non-facing sides of the walls 42, 44 (see FIGS. 7*f* and 7*g*), the grab bar 10 is thus locked into place between the two facing walls 42, 44 (see FIG. 7*h*).

The grab bar 10 may be removed from between the two facing walls 42, 44 by squeezing the protrusions 26, 28 inwards using a tool for example, thus disengaging them from the apertures 13 of the body 12, and allowing the body 12 to be pulled out from the openings 40.

Figure 8:
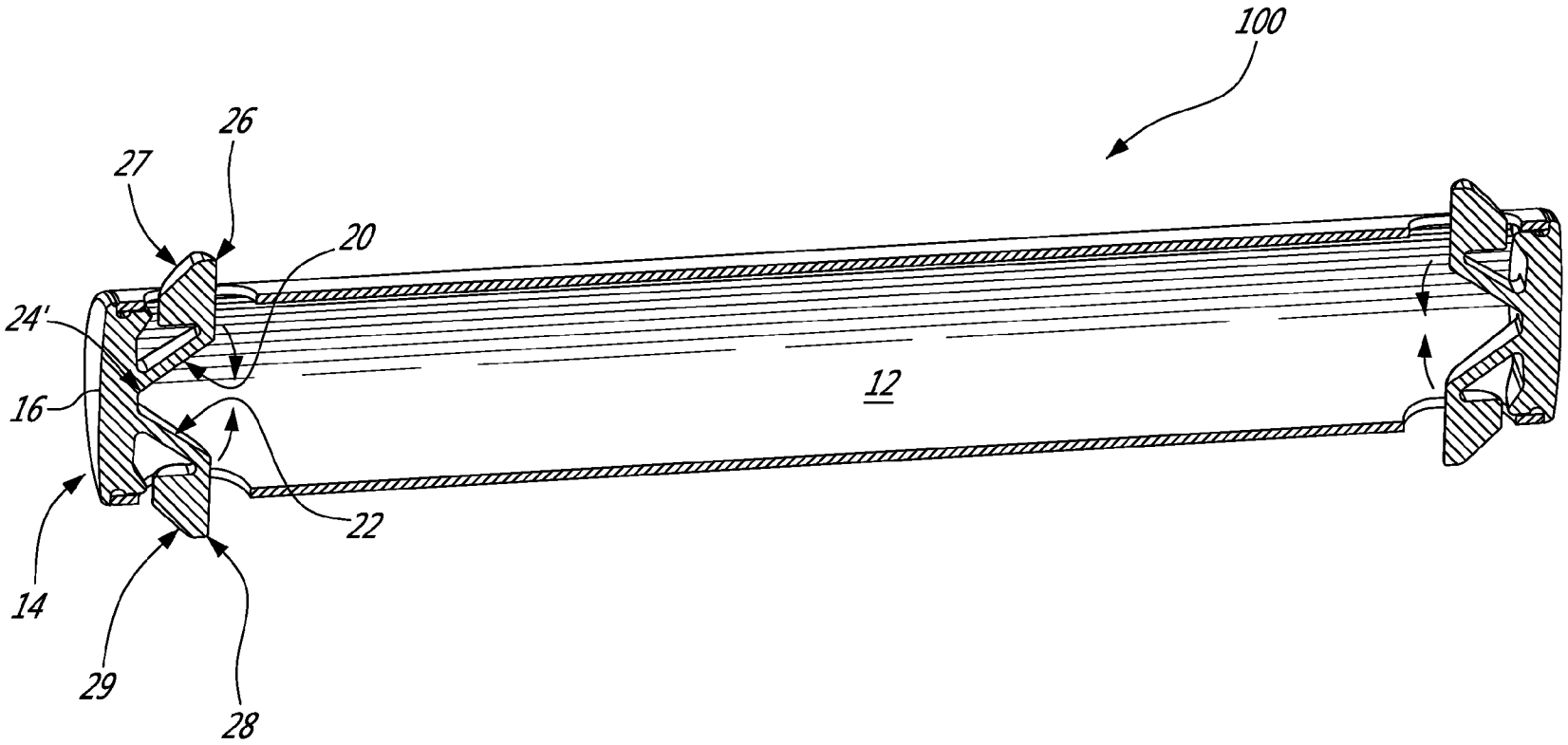
FIG. 8 is a sectional view of a grab bar according to an embodiment of an aspect of the present invention.

In another embodiment illustrated in FIG. 8, the side legs 20, 22 of the grab bar 100 are flexible about a pivot 24' on the inner surface of the cap 16. When inserting an end of the grab bar 100 in an opening 40 in a first wall 42 as described hereinabove in relation to FIG. 7*a* for example, the protrusions 26 and 28 at the free end of the side legs 20, 22 are pushed within the body 12 (see arrows in FIG. 8) by contact of their sloped surface 27, 29 with the edge of the opening 40, i.e. the side legs 20, 22 flex towards each other about the pivot 24', and then the protrusions 26 and 28 reemerge from the inside of the body 12 on the other side of the wall 42, and abut against this other side.

Figure 9:
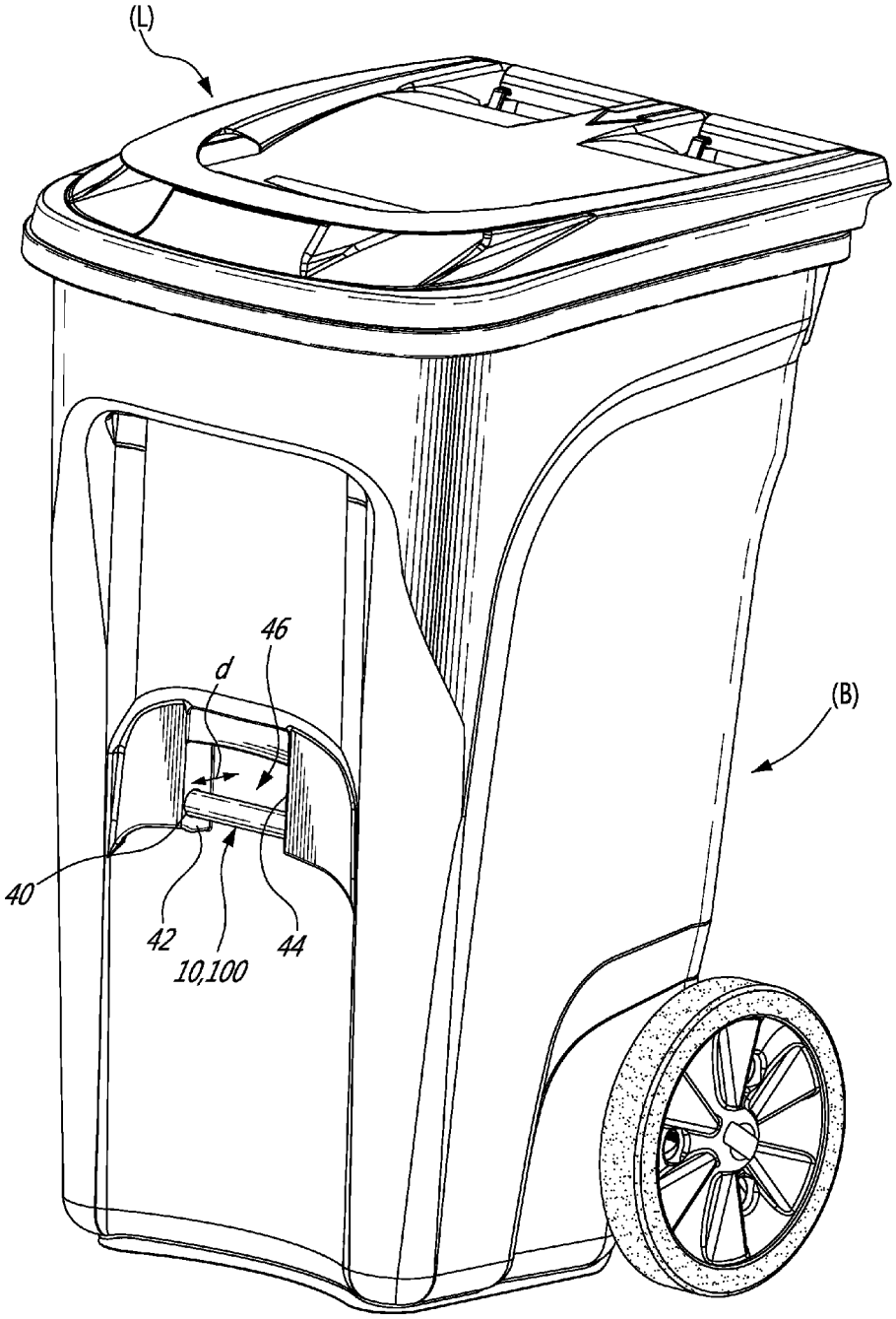
FIG. 9 is a perspective view of a container with a grab bar supported between two facing walls according to an embodiment of an aspect of the present invention.

FIG. 9 shows a container comprising a bin (B) defining a cavity, and a lid (L) rotatably connected to the bin (B) at a first end thereof and movable between an open position (not shown) giving access to the inside of the cavity and a closed position, illustrated in FIG. 9, preventing access to the inside of the cavity for example. The bin (B) comprises a base and side walls extending from the base. Two facing walls 42, 44 extend outwardly from an external surface of a side wall 46 of the bin (B), each provided with an opening 40 as described hereinabove, at a distance (d) from the bin (B) relative to the external surface of the side wall 46. Once a grab bar 10 or 100 as described hereinabove is secured through these openings within the space between the two facing walls 42, 44, the bar 10, 100 is in complete fluid isolation from the cavity, i.e. from the inside of the bin (B) of the container 100.

According to an aspect of the present invention, a method for providing a container with a grab bar in complete fluid isolation from the inside of the container comprises providing a container with an outer wall 46, providing two facing walls 42, 44 extending from this outer wall 46 and each provided with an opening 40 as described hereinabove, and securing a bar as described hereinabove through these openings within the space between the two facing walls 42, 44.

The scope of the claims should not be limited by the embodiments set forth in the examples, but should be given the broadest interpretation consistent with the description as a whole.

The invention claimed is:

1. A grab bar, comprising:

a body with open opposite ends and diametrically opposed apertures close to the open ends; and an end cap comprising a cap supporting a central leg extending from an inner surface of the cap, said central leg supporting a first side leg and a second side leg at an extremity of said central leg opposite the cap, said side legs being flexible about said extremity of said central leg, each side leg comprising a protrusion at a free extremity thereof opposite said extremity of said central leg;

wherein said side legs are adapted to flex inwards toward the central leg as the central leg is inserted within the body from the open end thereof until the protrusion of each side leg engages a respective one of the diametrically opposed apertures in the body and emerges out of the outer surface of the body, and the cap is generally flush with an edge of the open end of the body; and said side legs are adapted to flex inwards toward the central leg as the protrusion of each side leg are pushed toward the central leg thereby disengaging the protrusion from the diametrically opposed apertures in the body and allowing the cap to be pulled out from the open end of the body.

2. A container comprising a base and side walls extending from the base and defining a cavity, one of said side walls supporting two facing walls, extending from said side wall and each provided with an opening, and a grab bar of a length larger than a distance between the two facing walls and spaced outwardly from the container relative to an exterior surface of said side wall; wherein the grab bar, comprises:

a body with open opposite ends and diametrically opposed apertures close to the open ends; and a cap supporting a central leg extending from an inner surface of the cap, said central leg supporting a first side leg and a second side leg at an extremity of said central leg opposite the cap, said side legs being flexible about the extremity of said central leg, each side leg comprising a protrusion at a free extremity thereof opposite the extremity of said central leg;

wherein said side legs are adapted to flex inwards toward the central leg so as to enter the body until the protrusion of each side leg engages a respective one of the diametrically opposed apertures in the body and emerges out of the surface of the body, and the cap is generally flush with an edge of the open end of the body;

wherein said side legs are adapted to flex inwards toward the central leg as the protrusions are pushed inward inside the body thereby disengaging from the diametrically opposed apertures in the body and the cap is pulled out from the open end of the body;

wherein said grab bar is adapted to be positioned between the two facing walls, a first end of the body with the cap thereon being inserted within the opening of a first one of the two facing walls by a first side of the first wall, the first side of the first wall facing the second wall, the protrusions being pushed back within the body by contact with an edge of the first opening, and reemerging from the inside of the body on a second opposite side of the first wall; and a second end of the body with the cap thereon being inserted within the opening of a second one of the two facing walls by a first side of the second wall, the first side of the second wall facing the first side of the first wall, the protrusions being pushed back within the body by contact with an edge of the second opening, and reemerging from the inside of the body on a second opposite side of the second wall; and wherein said grab bar is adapted to be removed from between the two facing walls by squeezing the protrusions inwards, thus disengaging the protrusions from the apertures of the body.

3. A container, comprising:

a bin comprising a base and side walls extending from the base, said bin defining a cavity;

a pair of opposite walls extending outwardly from an external surface of one of the side walls of the bin and each provided with an opening at a distance from the bin relative to the external surface of the side wall; and a grab bar of a length larger than a distance between the opposite walls; said grab bar comprising a body with open opposite ends each comprising diametrically opposed apertures and a cap generally flush with an edge of the open end of the body and supporting a central leg extending from an inner surface of the cap within the body, said central leg supporting a first side leg and a second side leg at an extremity of said central leg opposite the cap, said side legs being flexible about the extremity of said central leg, each side leg comprising a protrusion at a free extremity thereof opposite the extremity of said central leg emerging out of the surface of the body through the aperture in the body;

wherein said side legs are adapted to flex inwards toward the central leg as the protrusions are pushed inward inside the body, a first end of the body of the grab bar cap is inserted within the opening in a first one of the pair of opposite walls, by a first side of said first wall, the protrusions being pushed back within the body, and reemerging from the inside of the body on a second side of said first wall; and a second end of the body of the grab bar cap is inserted within the opening in a second one of the pair of opposite walls, by a first side of said second wall facing said first wall, the protrusions being pushed back within the body, and reemerging from the inside of the body on a second side of said second wall, thereby coupling the grab bar to said container in complete fluid isolation from the cavity.

4. A method for providing a container with a grab bar in complete fluid isolation from the inside of the container, comprising:

providing two facing walls extending outwardly from an external surface of a side wall of the container;

providing each one of the two facing walls with an opening at a distance from the external surface of the side wall;

providing a grab bar of a length larger than a distance between the two facing walls; the grab bar comprising a body with open opposite ends each comprising diametrically opposed apertures and a cap supporting a first side leg and a second side leg extending within the body, each side leg comprising a protrusion at a free extremity thereof, the protrusion emerging out of the surface of the body through the aperture in the body, the side legs being adapted to flex inwards within the body so as to disengage the protrusion from the apertures in the body;

inserting a first end of the body of the grab bar cap within the opening in a first one of the two facing walls, by a first side of the first wall facing a second one of the two walls, the protrusions being pushed back within the body, and reemerging from the inside of the body on a second side of the first wall; and inserting a second end of the body of the grab bar cap within the opening in the second one of the two facing walls, by a first side of the second wall facing the first wall, the protrusions being pushed back within the body, and reemerging from the inside of the body on a second side of the second wall.

* * * * *